US008585427B2

(12) United States Patent
Ukawa et al.

(10) Patent No.: US 8,585,427 B2
(45) Date of Patent: Nov. 19, 2013

(54) CONNECTOR, CARD EDGE CONNECTOR, AND SENSOR USING THE SAME

(75) Inventors: Teiji Ukawa, Tokyo (JP); Toru Maeda, Tokyo (JP)

(73) Assignee: Nihon Kohden Corporation, Tokyo (JP)

( * ) Notice: Subject to any disclaimer, the term of this patent is extended or adjusted under 35 U.S.C. 154(b) by 311 days.

(21) Appl. No.: 13/046,734

(22) Filed: Mar. 12, 2011

(65) Prior Publication Data

US 2011/0230066 A1 Sep. 22, 2011

(30) Foreign Application Priority Data

Mar. 16, 2010 (JP) ..... 2010-059853

(51) Int. Cl.
*H01R 13/64* (2006.01)

(52) U.S. Cl.
USPC ..... 439/377; 439/468; 439/909

(58) Field of Classification Search
USPC ..... 439/660, 495, 496, 377, 468, 909; 600/382
See application file for complete search history.

(56) References Cited

U.S. PATENT DOCUMENTS

| | | | | | |
|---|---|---|---|---|---|
| 3,078,433 | A | * | 2/1963 | Sheesley | 439/278 |
| 4,289,366 | A | * | 9/1981 | Marks | 439/293 |
| 4,353,372 | A | * | 10/1982 | Ayer | 600/393 |
| 4,550,961 | A | * | 11/1985 | Aicher et al. | 439/92 |
| 4,695,112 | A | * | 9/1987 | Maston et al. | 439/350 |
| 4,768,969 | A | * | 9/1988 | Bauer et al. | 439/260 |
| 4,873,973 | A | * | 10/1989 | Hagen et al. | 606/32 |
| 4,952,177 | A | * | 8/1990 | Drake et al. | 439/838 |
| 5,083,939 | A | * | 1/1992 | Ittah | 439/496 |
| 5,176,676 | A | * | 1/1993 | Kurtze | 606/32 |
| 5,326,272 | A | * | 7/1994 | Harhen et al. | 439/86 |
| 5,387,122 | A | | 2/1995 | Goldberger et al. | |
| 5,407,368 | A | * | 4/1995 | Strand et al. | 439/729 |
| 5,683,261 | A | * | 11/1997 | Ahles et al. | 439/189 |
| 5,791,944 | A | * | 8/1998 | Grant et al. | 439/822 |
| 5,895,369 | A | * | 4/1999 | Flower | 604/20 |
| 6,062,915 | A | * | 5/2000 | Costello et al. | 439/729 |

(Continued)

FOREIGN PATENT DOCUMENTS

| | | | |
|---|---|---|---|
| JP | 3-57887 | U | 6/1991 |
| JP | 2002-325740 | A | 11/2002 |

OTHER PUBLICATIONS

Japanese Office Action for the related Japanese Patent Application No. 2010-059853 dated Jun. 18, 2013.

*Primary Examiner* — Neil Abrams
(74) *Attorney, Agent, or Firm* — Kenealy Vaidya LLP

(57) ABSTRACT

A connector includes: a card edge connector; a first cable drawn out from the card edge connector in a first direction; a first terminal disposed in the card edge connector and connected to the first cable; a receptacle into and from which the card edge connector is inserted and extracted; a second cable drawn out from the receptacle in a second direction; and a second terminal disposed in the receptacle and connected to the second cable. Insertion/extraction directions of the card edge connector are substantially perpendicular to at least one of the first direction and the second direction. The card edge connector includes a first end face which is substantially parallel to the insertion/extraction directions, and the receptacle includes a first wall face which is substantially parallel to the insertion/extraction directions. In a state where the card edge connector and the receptacle are coupled to each other, the first end face and the first wall face are in contact with each other.

11 Claims, 9 Drawing Sheets

(56) References Cited

U.S. PATENT DOCUMENTS

| | | | | |
|---|---|---|---|---|
| 6,152,754 | A | 11/2000 | Gerhardt et al. | |
| 6,168,459 | B1 * | 1/2001 | Cox et al. | 439/495 |
| 6,280,213 | B1 * | 8/2001 | Tobler et al. | 439/160 |
| 6,299,490 | B1 * | 10/2001 | Schultz et al. | 439/676 |
| 6,357,089 | B1 * | 3/2002 | Koguchi et al. | 24/536 |
| 6,453,186 | B1 * | 9/2002 | Lovejoy et al. | 600/386 |
| 6,582,252 | B1 * | 6/2003 | Lin | 439/607.46 |
| 6,623,312 | B2 * | 9/2003 | Merry et al. | 439/729 |
| 6,645,001 | B2 * | 11/2003 | Okano | 439/492 |
| 6,811,431 | B2 * | 11/2004 | Hsieh | 439/495 |
| 6,969,274 | B2 * | 11/2005 | Kudo et al. | 439/495 |
| 7,132,641 | B2 * | 11/2006 | Schulz et al. | 250/221 |
| 7,261,580 | B1 * | 8/2007 | Secora | 439/341 |
| 7,364,440 | B2 * | 4/2008 | Gobron et al. | 439/77 |
| 7,616,980 | B2 * | 11/2009 | Meyer | 600/382 |
| 7,654,829 | B1 * | 2/2010 | Chuang et al. | 439/67 |
| 7,749,013 | B2 * | 7/2010 | Sato et al. | 439/281 |
| 8,197,276 | B2 * | 6/2012 | Egloff et al. | 439/268 |
| 8,280,506 | B2 * | 10/2012 | Vaisnys et al. | 607/5 |
| 2011/0230066 | A1 * | 9/2011 | Ukawa et al. | 439/59 |

* cited by examiner

CONNECTOR, CARD EDGE CONNECTOR, AND SENSOR USING THE SAME

BACKGROUND OF THE INVENTION

The present invention relates to a connector in which a slipping-off preventing countermeasure is taken so as not to slip off when a cable is pulled, a card edge connector, and a sensor using it, and more particularly to a connector which does not require an additional member for providing a slipping-off preventing countermeasure, and further operations of setting and cancelling such a countermeasure, a card edge connector which is used in such a connector, and a sensor using such a card edge connector.

As a countermeasure for preventing a connector for a junction cord and a probe connector connected thereto from slipping off, there is a related-art configuration in which the junction cord connector includes a cover that covers the whole of the probe connector excluding a cable and that is swingable. The cover holds the probe connector therein in a state where it covers the probe connector, to block a movement of the probe connector in the pulling-out direction.

In the configuration, however, it is necessary to dispose a special additional member in the connector, and therefore there is a problem in that the configuration is large in scale and hence the production cost is increased.

In another related-art configuration, a locking mechanism using a spring is disposed in a connector for a junction cord, and, when a probe connector is connected, the locking mechanism operates so as to exert a slipping-off preventing function (see U.S. Pat. No. 5,387,122 and U.S. Pat. No. 6,152,754).

Also in the slipping-off preventing configuration, however, an additional member is required in addition to the connector, and, when the connector is to be disconnected, it is necessary to operate a tab or a button in order to cancel the function of the locking mechanism. Therefore, there is a problem in that the operation is cumbersome.

There is further another related-art configuration in which a flange is disposed in a male connector, and the flange is fitted into a groove hole of a female connector, thereby preventing slipping-off (see JP-A-2002-325740).

The related-art connectors have advantages in that the configuration is simple, and that a special operation of cancelling a locked state is not required. However, it is difficult to adjust the fitting force. Therefore, there is a possibility that the connectors may easily slip off from each other, or, when the connectors are once coupled to each other, it may be very difficult to disconnect the connectors from each other. Consequently, the connectors may be inconvenient in actual use.

SUMMARY

It is therefore an object of the invention to provide a connector which does not require a special additional member, and operations of setting and cancelling a slipping-off preventing countermeasure, and in which, although the connector can be easily inserted and extracted, slipping-off can be adequately prevented from occurring.

In order to achieve the object, according to the invention, there is provided a connector comprising: a card edge connector; a first cable which is drawn out from the card edge connector in a first direction; a first terminal which is disposed in the card edge connector and which is connected to the first cable; a receptacle into and from which the card edge connector is inserted and extracted; a second cable which is drawn out from the receptacle in a second direction; and a second terminal which is disposed in the receptacle and which is connected to the second cable, wherein when the card edge connector is inserted into the receptacle, the first terminal is electrically connected to the second terminal, insertion/extraction directions of the card edge connector are substantially perpendicular to at least one of the first direction and the second direction, the card edge connector includes a first end face which is substantially parallel to the insertion/extraction directions, the receptacle includes a first wall face which is substantially parallel to the insertion/extraction directions, and in a state where the card edge connector and the receptacle are coupled to each other, the first end face and the first wall face are in contact with each other so as to receive at least one of a pulling force of the first cable in the first direction and a pulling force of the second cable in the second direction.

The card edge connector may include a second end face which is substantially parallel to the insertion/extraction directions, and the receptacle may include a second wall face which is substantially parallel to the insertion/extraction directions. In the state where the card edge connector and the receptacle are coupled to each other, the second end face and the second wall face may be in contact with each other so as to receive at least one of a pushing-in force of the first cable in a direction opposite to the first direction and a pushing-in force of the second cable in a direction opposite to the second direction.

The card edge connector may include a third end face which is substantially perpendicular to the insertion/extraction directions, and the receptacle may include a third wall face which is substantially perpendicular to the insertion/extraction directions. In the state where the card edge connector and the receptacle are coupled to each other, the third end face and the third wall face may be in contact with each other.

The card edge connector may include a fourth end face which is substantially parallel to the insertion/extraction directions, and the receptacle may include a fourth wall face which is substantially parallel to the insertion/extraction directions. In the state where the card edge connector and the receptacle are coupled to each other, the fourth end face and the fourth wall face may be in contact with each other so as to receive at least one of a pushing-in force of the first direction in a direction opposite to the first cable and a pushing-in force of the second cable in a direction opposite to the second direction.

One of concave and convex portions which are fitted to each other in the state where the card edge connector and the receptacle are coupled to each other may be formed in the second end face and the other of the concave and convex portions may be formed in the second wall face.

The first terminal may include a terminal for current use and an extension terminal.

The first cable may be formed by a wiring pattern of a flexible printed circuit board and is connected to a sensor, the first terminal may be formed by exposing the wiring pattern of the flexible printed circuit board in a tip end portion on an insertion side of the insertion/extraction directions of the card edge connector, and the card edge connector may be formed by the flexible printed circuit board and a reinforcing plate which are overlaid and bonded with each other.

With respect to a line which passes through a drawn-out portion of the second cable and which is perpendicular to the insertion/extraction directions, a drawn-out portion of the first cable may be positioned on a side of the insertion direction of the card edge connector.

With respect to a line which passes through a drawn-out portion of the first cable and which is perpendicular to the insertion/extraction directions, a drawn-out portion of the second cable may be positioned on a side of the extraction direction of the card edge connector.

In order to achieve the object, according to the invention, there is also provided a card edge connector to be used in the connector.

In order to achieve the object, according to the invention, there is also provided a sensor using the card edge connector.

DETAILED DESCRIPTION OF EMBODIMENTS

Figure 1:
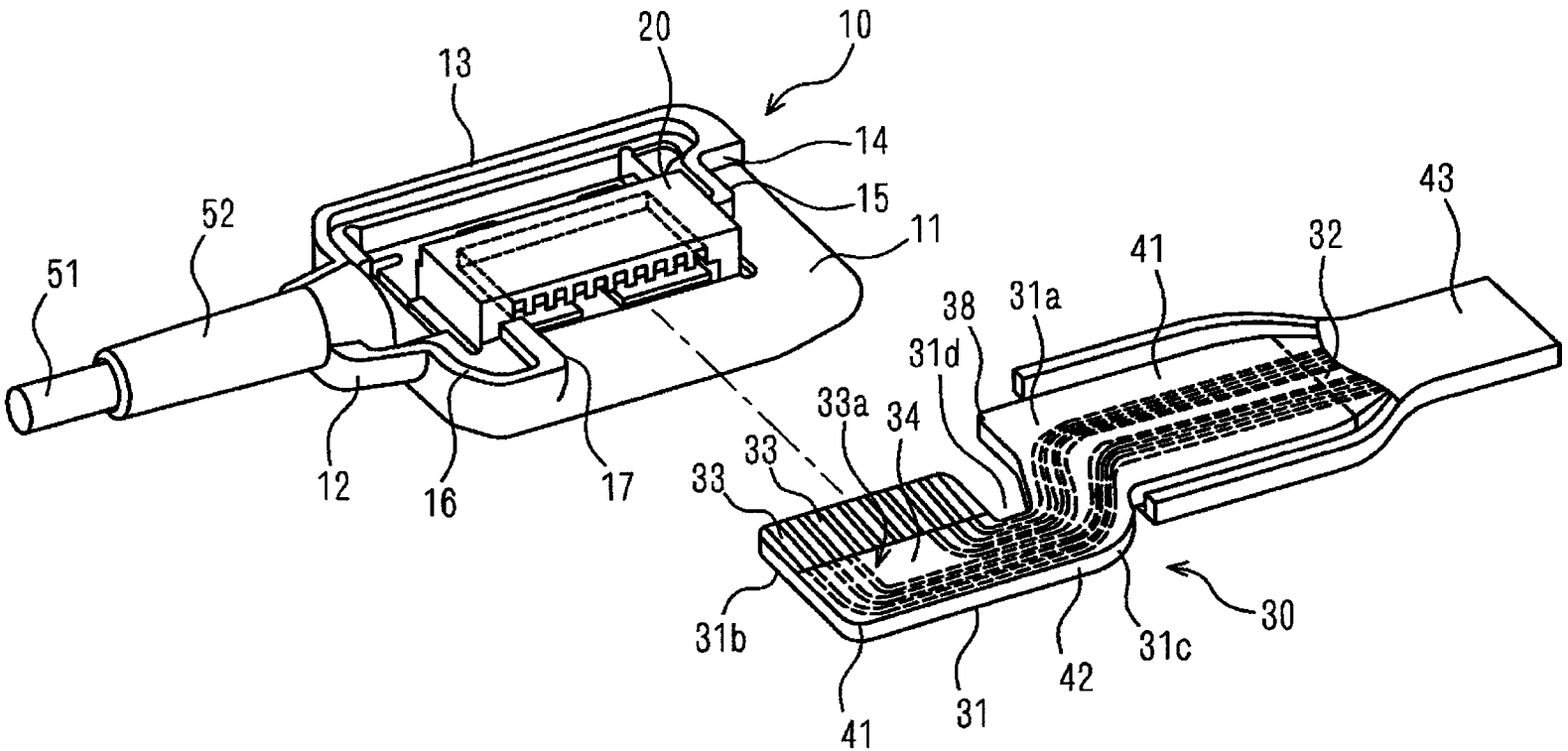
FIG. 1 is an assembly perspective view of a part of a connector of a first embodiment of the invention, partly cutaway.
Figure 2:
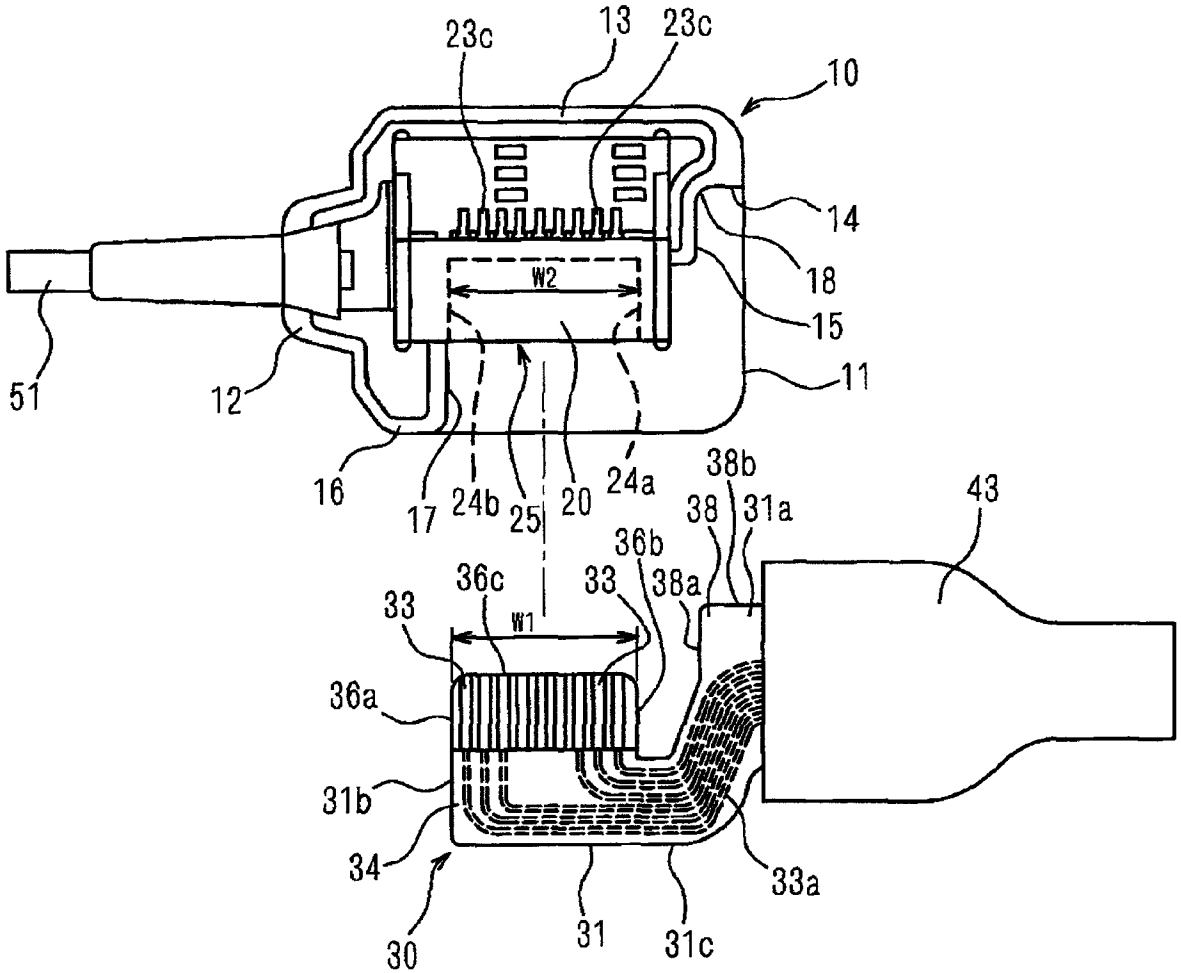
FIG. 2 is an assembly plan view of a part of the connector of the first embodiment of the invention.

Hereinafter, embodiments of the connector of the invention will be described with reference to the accompanying drawings. In the figures, the identical components are denoted by the same reference numerals, and duplicated description will be omitted. FIGS. 1 to 6 show a connector of a first embodiment. The connector is configured by a receptacle 10 and a plug 30. The plug 30 is a card edge connector 31, and formed by a flexible printed circuit board (hereinafter, referred to as FPC) 41 and a rigid circuit board 42 functioning as a reinforcing plate. One end of the FPC is print-wired to be formed as a cable 32 (a first cable), and connected to a probe portion 50 (a sensor) of a pulse oximeter. The rigid circuit board is bonded to the other end of the FPC by using an adhesive agent or a sticky agent. The card edge connector 31 includes a basal portion 31*a* a part of which is covered by a cover 43 formed by a nonwoven fabric, an insertion/extraction board portion 31*b* which has a substantially rectangular shape in a plan view, and an intermediate portion 31*c* which is positioned between the basal portion 31*a* and the insertion/extraction board portion 31*b*.

A recess portion 31*d* is formed between the basal portion 31*a* and the insertion/extraction board portion 31*b*, so that the intermediate portion 31*c* has a narrow constricted part. A sidewall 36*c* of the insertion/extraction board portion 31*b* is formed substantially parallel to a direction which is described later, and in which the cable 32 is drawn out from the card edge connector 31. The sidewall 36*c* is inserted into the receptacle 10 while being opposed thereto. Therefore, the portion of the insertion/extraction board portion 31*b* on the side of the sidewall 36*c* is referred to as the tip end portion. A plurality of terminals 33 (first terminals) which are configured by a wiring pattern are disposed on the FPC 42 in the tip end portion. The wiring pattern 33*a* which extends from the terminals 33 (first terminals) is covered and insulated by a resist 34, excluding the portion of the terminals 33.

In the embodiment, the portions in the range from the terminals 33 to the probe portion 50 are seamlessly connected by a wiring pattern 33 which is print-wired on the FPC 41. The wiring pattern from an end portion of the basal portion 31*a* on the side of the probe portion 50 is referred to as a cable 32, and the end portion is referred to as a drawn-out portion of the cable 32. The cover 43 covers a range which extends from a part of the basal portion 31*a* to the probe portion 50 through the FPC 41.

The receptacle 10 has a configuration where a receptacle holder 20 is placed on and fixed to a base housing 11 having an area which is very larger than that of the card edge connector 31.

Figure 5A:
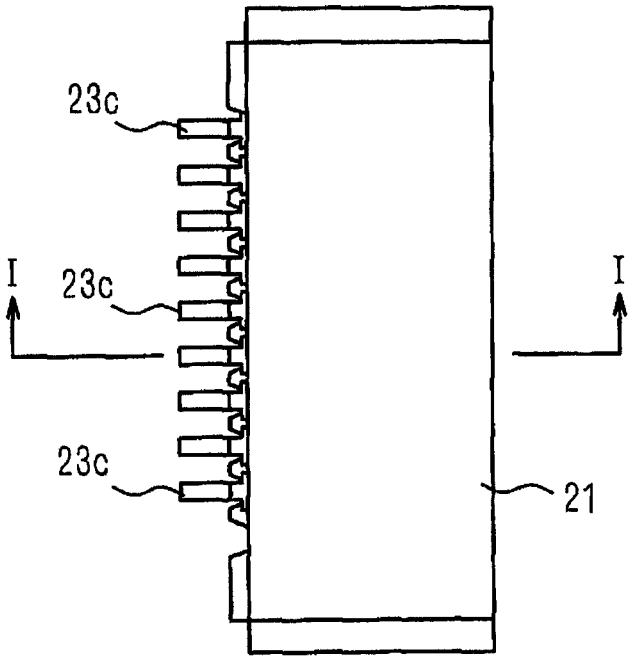
FIG. 5A is a plan view of a receptacle holder used in the connector of the first embodiment of the invention.
Figure 5B:
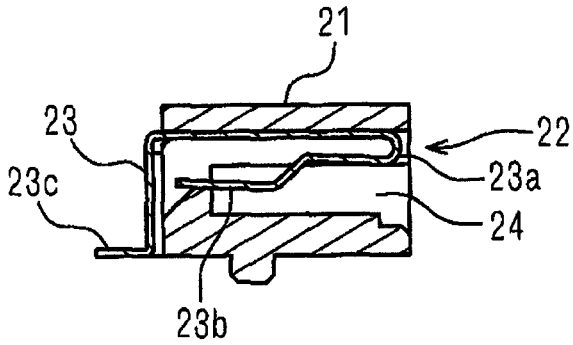
FIG. 5B is a sectional view taken along I-I in FIG. 5A.

In the receptacle holder 20, as shown in FIGS. 5A and 5B, a plurality of conductive female terminals 23 the number of which corresponds to that of the terminals 33 of the card edge connector 31 are housed in an inner chamber 22 of a housing 21 having a rectangular parallelepiped shape. The inner chamber 22 includes a receiving hole 24 which is formed in a middle portion in a laterally elongated manner. About a half of the insertion/extraction board portion 31*b* from which the terminals 33 of the card edge connector 31 are exposed is inserted into the receiving hole 24.

FIG. 5B is a sectional view taken along I-I in FIG. 5A. Each of the female terminals 23 is folded back in a fold back potion 23*a*, and a contact portion 23*b* which is to be contact with the corresponding terminal 33 of the card edge connector 31 is formed in a tip end portion of the folded back female terminal 23 (a second terminal) which is in the lower side. According to the configuration, the range between the fold back potion 23*a* and the contact portion 23*b* is elastic, and the contact portion 23*b* is contacted with the inserted terminal 33 while pressing the terminal 33.

In the female terminals 23, contact portions 23*c* are formed in the end portions opposite to the contact portions 23*b*, and the contact portions 23*c* are connected to a plurality of lead wires of a cable 51 which is connected to the body unit of the pulse oximeter (not shown). The cable 51 is drawn out to the outside through a drawn-out portion 12 of the base housing 11.

On the side of the rear face (the face opposite to that where the receiving hole 24 is opened) of the receptacle holder 20, an outer wall 13 which extends from the drawn-out portion 12 is formed in the end edge of the base housing 11. A wall face 14 (a third wall face) which is perpendicularly inwardly bent from an edge portion of the base housing 11 is formed, and furthermore a wall face 15 (a second wall face) which is perpendicularly bent in the vicinity of an edge portion of the receptacle holder 20 is formed so as to extend along the outer sidewall.

An outer wall 16 which extends from the drawn-out portion 12 in the direction opposite to the outer wall 13 is formed. The outer wall 16 is perpendicularly bent from an edge portion of the base housing 11 which is in the vicinity of an edge portion of the receptacle holder 20 on the side of the surface (the face where the receiving hole 24 is opened), to form a wall face 17, and butts against the surface side of the receptacle holder 20 to terminate.

The width W1 of the insertion/extraction board portion 31*b* where the terminals 33 in the card edge connector 31 are disposed is substantially equal to the width W2 of the receiving hole 24 in the receptacle holder 20. In the basal portion 31*a* of the card edge connector 31, an edge portion 38 which is positioned in the inlet portion of the recess portion 31*d* is formed into a shape which coincides with that of an edge portion 18 that is formed by the wall faces 14, 15 of the receptacle 10.

Figure 4:
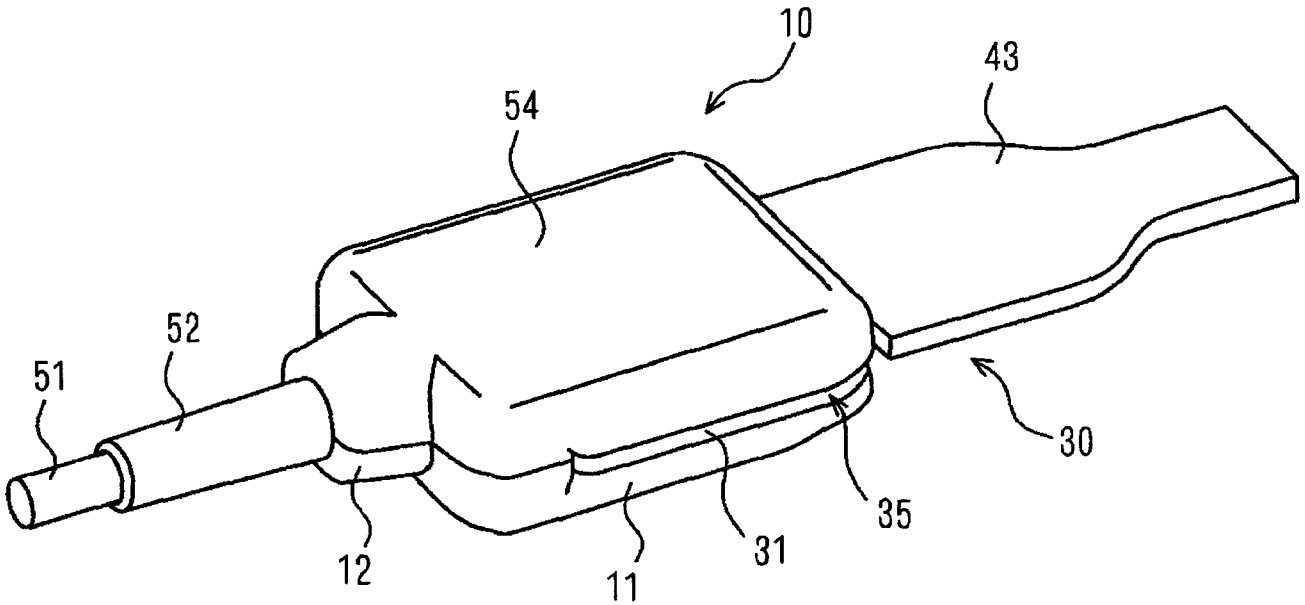
FIG. 4 is a perspective view of a part showing a state where a lid of the connector of the first embodiment of the invention is closed.

In a state where a lid 54 is put on the base housing 11, an opening portion 35 is formed between the lid 54 and the base housing 11. When the card edge connector 31 is inserted through the opening portion 35, the receptacle 10 and the plug 30 are electrically connected to each other (FIG. 4). In the state where the receptacle 10 and the plug 30 are connected to each other, the axis of the cable 32 (the drawn-out direction of the cable 32), and that of the cable 51 (the drawn-out direction of the cable 51) are substantially on the same straight line as shown in FIG. 6.

As indicated by the arrow C, the insertion/extraction directions of the receptacle 10 and the plug 30 are substantially perpendicular to the axes of the cable 32, 51. When the plug 30 is to be inserted into the receptacle 10, an end face 36*a* (a fourth end face) of the insertion/extraction board portion 31*b* of the card edge connector 31 is caused to slide over the wall face 17 of the base housing 11 to be inserted.

When the terminals 33 are advanced to be inserted into the receiving hole 24 of the receptacle holder 20, an end face 38*a* (a second end face) constituting the edge portion 38 formed in the basal portion 31*a* of the card edge connector 31 slides along the wall face 15 of the base housing 11, and an end face 38*b* (a third end face) constituting the edge portion 38 butts against the wall face 14 of the base housing 11 to terminate the insertion. In this state, the terminals 33 are contacted with the female terminals 23 to be electrically connected thereto.

Figure 3:
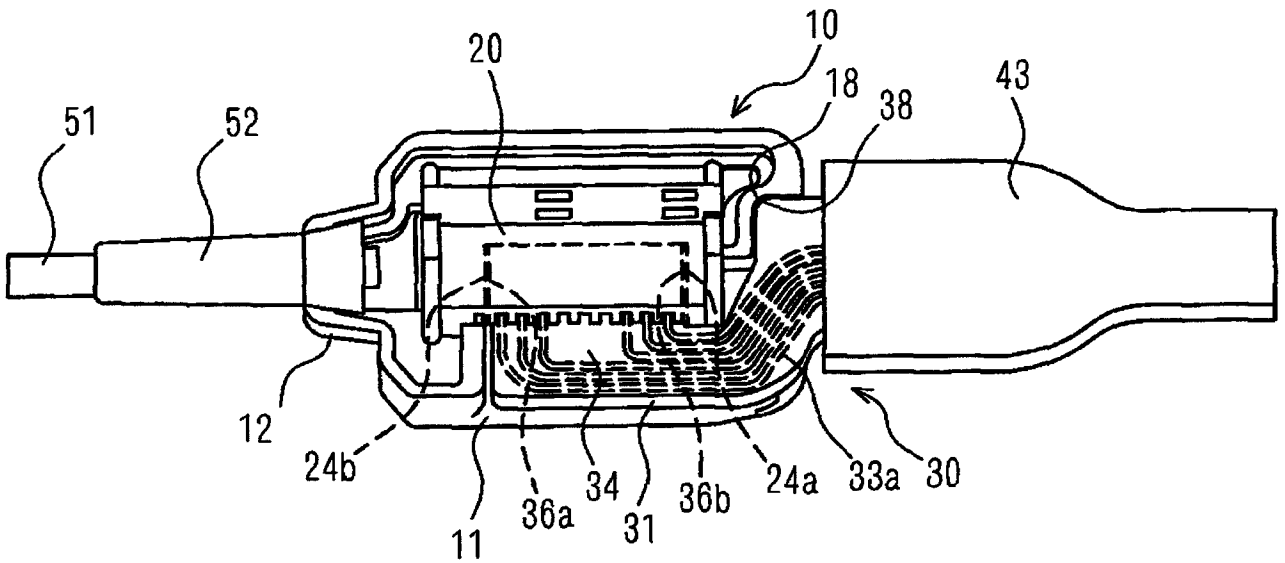
FIG. 3 is a perspective view of a part showing a coupled state of the connector of the first embodiment of the invention.
Figure 6:
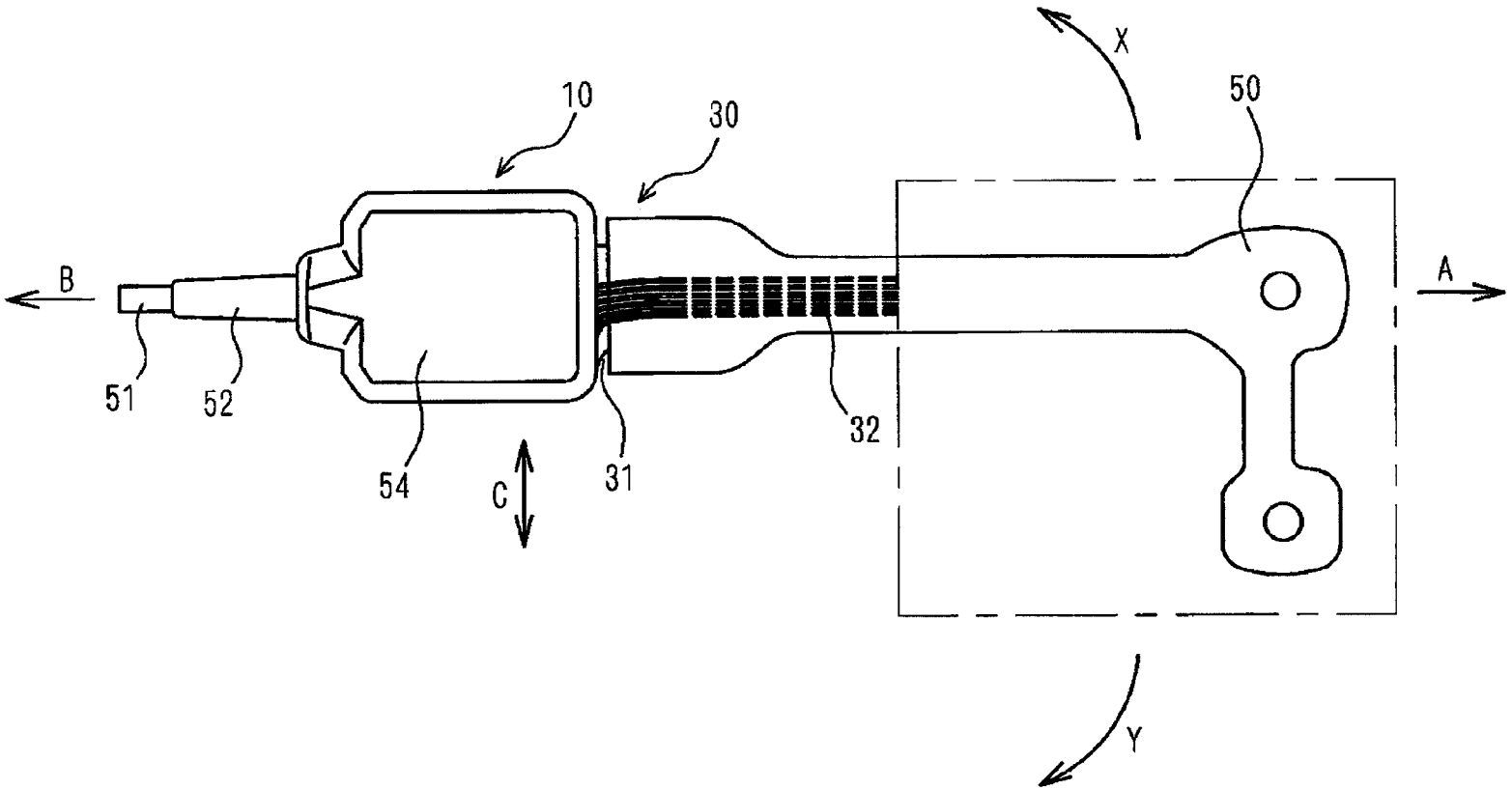
FIG. 6 is a plan view showing a case where the connector of the first embodiment of the invention is applied to a probe.

In the state where the insertion of the insertion/extraction board portion 31*b* of the card edge connector 31 into the receptacle holder 20 is completed, in the case where the cables 32, 51 are pulled respectively in the directions of the arrows A, B in FIG. 6, an end face 36*b* (a first end face) of the insertion/extraction board portion 31*b* of the card edge connector 31 butts against a wall face 24*a* (a first wall face) of the receiving hole 24 of the receptacle holder 20 because the width W1 of the insertion/extraction board portion 31*b* is substantially equal to the width W2 of the receiving hole 24 in the receptacle holder 20, to function so as to block the movement of the card edge connector 31, and therefore the plug 30 is prevented from slipping off from the receptacle 10 (FIG. 3).

In the state where the insertion of the insertion/extraction board portion 31*b* of the card edge connector 31 into the receptacle holder 20 is completed, the edge portion 38 of the card edge connector 31 butts against the edge portion 18 formed by the wall faces 14, 15 of the receptacle 10, and the wall face 15 (the second wall face) and the wall face 14 (the third wall face) are contacted with against the end face 38*a* (the second end face) and the end face 38*b* (the third end face), respectively. In the case where the probe portion 50 is pulled in the direction indicated by the arrow X or Y in FIG. 6, therefore, the wall faces 14, 15 function so as to block the rotational movement of the card edge connector 31, thereby causing the plug 30 from hardly slipping off from the receptacle 10. This function is realized also by butting of the end face 36*a* (the fourth end face) of the insertion/extraction board portion 31*b* of the card edge connector 31 against a wall face 24*b* (a fourth wall face) of the receiving hole 24 of the receptacle holder 20.

Figure 7:
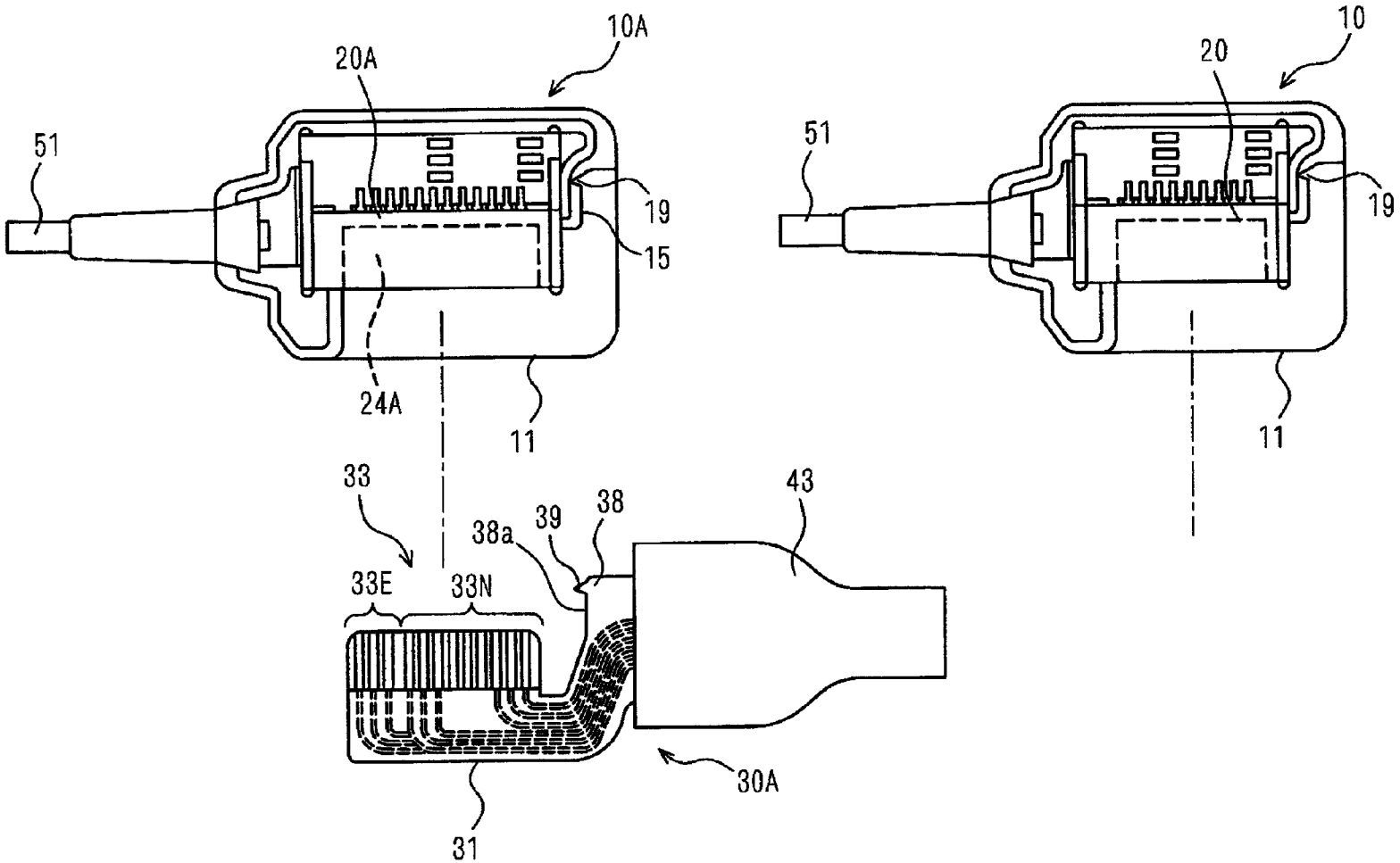
FIG. 7 is a plan view of a part showing a connector of a second embodiment of the invention.

FIG. 7 is a plan view of a connector of a second embodiment. In the embodiment, a projection 39 is projected from the end face 38*a* (the second end face) of the card edge connector 31. In correspondence with the projection 39, a recess 19 is formed in the wall face 15 (the second wall face) of a receptacle 10A. According to the configuration, in the state where the insertion of the insertion/extraction board portion 31*b* of the card edge connector 31 into a receptacle holder 20A is completed, the projection 39 is fitted into the recess 19. Therefore, the recess 19 and the projection 39 function as concavo-convex portions which suppress rotational movement of the receptacle 10A or a plug 30A. In the embodiment, as described above, the end face 38*a* is formed with the projection 39 and the wall face 15 is formed with the recess 19. However, the end face 38*a* may be formed with a recess and the wall face 15 may be formed with a projection that is adapted to be fitted into the recess.

In the embodiment, terminals for current use 33N and extension terminals 33E are disposed as the terminals 33 of the plug 30A. The extension terminals 33E are used in the case where electronic devices which realize an extension function, such as a plurality of sensors or LEDs are disposed in the probe portion 50. Only when the extension terminals 33E are used, these are connected to electronic devices which realize an extension function.

The receptacle holder 20A includes a receiving hole 24A which is larger by a degree corresponding to the extension terminals 33E. The receptacle holder 20 of the receptacle 10 includes the receiving hole 24 the size of which corresponds to the terminals for current use 33N. A measuring device (body unit) corresponding to the extension terminals 33E is not connected to the receptacle 10. Therefore, the plug 30A cannot be inserted into the receptacle 10, and hence the plug 30A having the probe portion 50 including electronic devices which realize an extension function is not erroneously connected to the receptacle 10. The receptacle holder 20A corresponds and can be connected to both the plug 30 shown in FIGS. 1 to 6, and the plug 30A of the embodiment.

Figure 8:
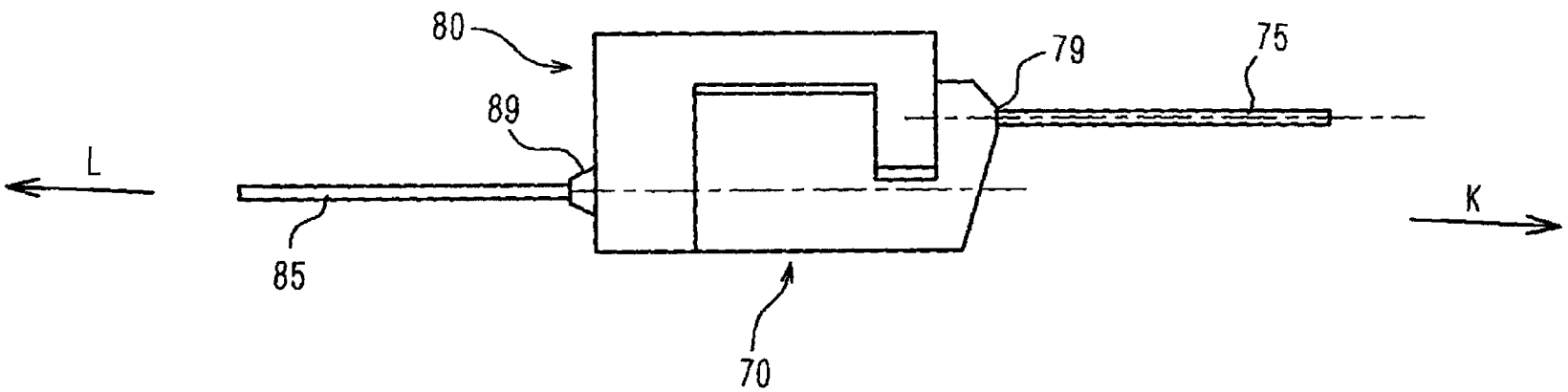
FIG. 8 is a plan view showing a state where a cable has not yet been pulled in a coupled state of a connector of a third embodiment of the invention.
Figure 9:
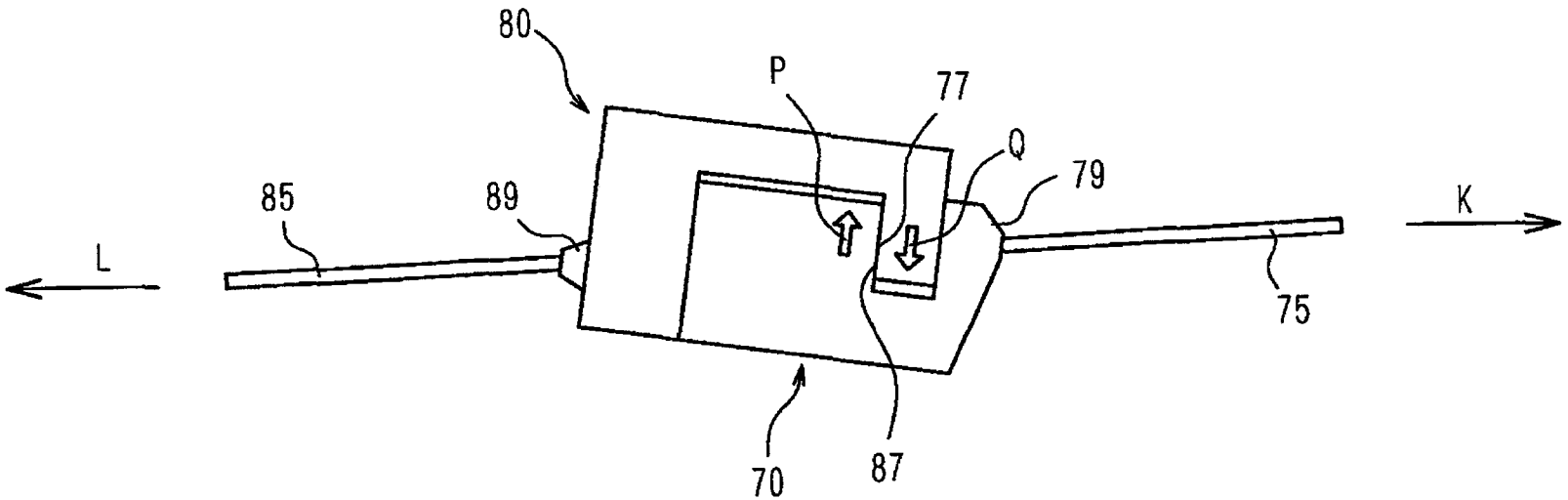
FIG. 9 is a plan view showing a state where the cable has been pulled in the coupled state of the connector of the third embodiment of the invention.

FIGS. 8 and 9 schematically show a connector of a third embodiment. In the above-described first and second embodiments, in the state where the receptacle 10 (10A) and the plug 30 (30A) are connected to each other, the axis of the cable 32 and that of the cable 51 are substantially on the same straight line as shown in FIG. 6. By contrast, the embodiment is configured so that, in the state where the receptacle and the plug are connected to each other, the axis of a cable on the side of the receptacle is not aligned with that of a cable on the side of the plug. This is the difference from the first and second embodiments.

FIG. 8 shows a state where a plug 70 and a receptacle 80 are connected to each other. The reference numeral 75 denotes a cable (first cable) which is drawn out from a drawn-out portion 79 of the plug 70 to be connected to a probe (not shown). The reference numeral 85 denotes a cable (second cable) which is drawn out from a drawn-out portion 89 of the receptacle 80 to be connected to the body unit of the pulse oximeter (not shown). FIG. 8 shows a state where the cables 75, 85 are not pulled.

The positional relationship between the drawn-out portion 79 of the cable 75 and the drawn-out portion 89 of the cable 85 is set in the following manner. With respect to a straight line which passes through the drawn-out portion 89 of the cable 85, and which is perpendicular to the insertion/extraction directions of the plug 70 and the receptacle 80, the drawn-out portion 79 of the cable 75 is positioned on the side of the insertion direction of the plug 70. In other words, with respect to a straight line which passes through the drawn-out portion 79 of the cable 75, and which is perpendicular to the insertion/extraction directions of the plug 70 and the receptacle 80, the drawn-out portion 89 of the cable 85 is positioned on the side of the extraction direction of the plug 70.

In the configuration, when the cable 75 is pulled in the direction of the arrow K and the cable 85 is pulled in the direction of the arrow L, the plug 70 and the receptacle 80 are integrally rotated to attain the state of FIG. 9. In this state, the axis of the cable 75 and that of the cable 85 are substantially on the same straight line. With respect to this straight line, the insertion/extraction directions of the plug 70 and the receptacle 80, i.e., a side wall 77 (corresponding to the end face 36*b* in FIG. 2) of the plug 70 and a wall face 87 (corresponding to the wall face 24*a* in FIG. 2) are not perpendicular. Therefore, the plug 70 and the receptacle 80 receive forces in the directions indicated by the arrows P, Q, respectively. These forces function in the directions along which the plug 70 and the receptacle 80 are coupled to each other, and hence prevent the plug 70 from slipping off from the receptacle 80.

Although, in the embodiments, examples in which the invention is applied to a connector of a pulse oximeter have been described, the invention is not limited to the embodiments.

According to an aspect of the invention, the connector is configured so that the card edge connector is used, and the insertion/extraction directions of the card edge connector are substantially perpendicular to the drawn-out direction of the first cable and/or the second cable. In the case where the cable is pulled, therefore, the first end face and the first wall face butt against each other, whereby movements of the receptacle and the card edge connector are blocked, so that slipping-off can be prevented from occurring without particularly using an additional member. Moreover, the configuration does not affect the insertion/extraction force acting between the receptacle and the card edge connector. This is preferable.

According to an aspect of the invention, the pushing-in force in the extraction direction of the cable is received by the butting of the second end face and the second wall face. Therefore, the movements of the receptacle and the card edge connector are blocked, so that slipping-off can be prevented from occurring.

According to an aspect of the invention, the connector is configured so that the third end face and the third wall face can butt against each other. In a state where the card edge connector and the receptacle are coupled to each other, therefore, restriction is performed also in the insertion direction of the card edge connector. Even when the cable is pulled in a direction other than the drawn-out direction and a force in the rotation direction is applied to the card edge connector and the receptacle, therefore, slipping-off can be effectively prevented from occurring.

According to an aspect of the invention, the pushing-in force in the extraction direction of the cable is received by the butting of the fourth end face and the fourth wall face. Therefore, it is possible to attain adequate contact and slipping-off prevention.

According to an aspect of the invention, the concave portion, which is formed in one of the second end face and the second wall face, and the convex portion, which is formed in the other of the second end face and the second wall face, are fitted to each other, whereby slipping-off can be prevented more surely from occurring.

According to an aspect of the invention, the terminals for current use, and the extension terminals are disposed in the card edge connector. Therefore, the case where the number of sensors to be connected or function of an apparatus is extended can be coped with by using the extension terminals. This is convenient.

According to an aspect of the invention, the components in the range extending from the sensor and the terminals are formed by the flexible printed circuit board. Therefore, the connector has a simple configuration, and a high reliability.

According to an aspect of the invention, in the case where the first cable and/or the second cable is pulled, a force in the insertion direction is applied to each of the card edge connector and the receptacle. Therefore, slipping-off can be further prevented from occurring.

According to an aspect of the invention, when the card edge connector is combined with the above-described receptacle, it is possible to attain effects that the configuration is simple, that an additional member is not necessary, that operations of setting and cancelling the slipping-off preventing countermeasure are not required, and that sure slipping-off prevention is achieved.

According to an aspect of the invention, when the card edge connector of the invention is used in a sensor, and combined with the above-described receptacle, the sensor can attain effects that the configuration is simple, that an additional member is not necessary, that operations of setting and cancelling the slipping-off preventing countermeasure are not required, and that sure slipping-off prevention effect is achieved.

What is claimed is:

1. A connector comprising:

a card edge connector;

a first cable which is drawn out from the card edge connector in a first direction;

a first terminal which is disposed in the card edge connector and which is connected to the first cable;

a receptacle into and from which the card edge connector is inserted and extracted;

a second cable which is drawn out from the receptacle in a second direction that is opposite or substantially opposite the first direction; and a second terminal which is disposed in the receptacle and which is connected to the second cable, wherein when the card edge connector is inserted into the receptacle, the first terminal is electrically connected to the second terminal, insertion/extraction directions of the card edge connector are substantially perpendicular to at least one of the first direction and the second direction, the card edge connector includes a first end face which is substantially parallel to the insertion/extraction directions, the receptacle includes a first wall face which is substantially parallel to the insertion/extraction directions, and in a state where the card edge connector and the receptacle are coupled to each other, the first end face and the first wall face are in contact with each other so as to receive at least one of a pulling force of the first cable in the first direction and a pulling force of the second cable in the second direction, and wherein the pulling force of the first cable and the pulling force of the second cable are in opposing directions along substantially a same line.

2. The connector according to claim 1, wherein the card edge connector includes a second end face which is substantially parallel to the insertion/extraction directions, the receptacle includes a second wall face which is substantially parallel to the insertion/extraction directions, and in the state where the card edge connector and the receptacle are coupled to each other, the second end face and the second wall face are in contact with each other so as to receive at least one of a pushing-in force of the first cable in a direction opposite to the first direction and a pushing-in force of the second cable in a direction opposite to the second direction.

3. The connector according to claim 1, wherein the card edge connector includes a third end face which is substantially perpendicular to the insertion/extraction directions, the receptacle includes a third wall face which is substantially perpendicular to the insertion/extraction directions, and in the state where the card edge connector and the receptacle are coupled to each other, the third end face and the third wall face are in contact with each other.

4. The connector according to claim 1, wherein the card edge connector includes a fourth end face which is substantially parallel to the insertion/extraction directions, the receptacle includes a fourth wall face which is substantially parallel to the insertion/extraction directions, and in the state where the card edge connector and the receptacle are coupled to each other, the fourth end face and the fourth wall face are in contact with each other so as to receive at least one of a pushing-in force of the first cable in a direction opposite to the first direction and a pushing-in force of the second cable in a direction opposite to the second direction.

5. The connector according to claim 2, wherein one of concave and convex portions which are fitted to each other in the state where the card edge connector and the receptacle are coupled to each other is formed in the second end face and the other of the concave and convex portions is formed in the second wall face.

6. The connector according to claim 1, wherein the first terminal includes a terminal for current use and an extension terminal.

7. The connector according to claim 1, wherein the first cable is formed by a wiring pattern of a flexible printed circuit board and is connected to a sensor, the first terminal is formed by exposing the wiring pattern of the flexible printed circuit board in a tip end portion on an insertion side of the insertion/extraction directions of the card edge connector, and the card edge connector is formed by the flexible printed circuit board and a reinforcing plate which are overlaid and bonded with each other.

8. The connector according to claim 1, wherein with respect to a line which passes through a drawn-out portion of the second cable and which is perpendicular to the insertion/extraction directions, a drawn-out portion of the first cable is positioned on a side of the insertion direction of the card edge connector.

9. The connector according to claim 1, wherein with respect to a line which passes through a drawn-out portion of the first cable and which is perpendicular to the insertion/extraction directions, a drawn-out portion of the second cable is positioned on a side of the extraction direction of the card edge connector.

10. A card edge connector to be used in the connector according to claim 1.

11. A sensor using the card edge connector according to claim 10.

* * * * *